United States Patent [19]

Bechtold

[11] Patent Number: 4,973,189

[45] Date of Patent: Nov. 27, 1990

[54] COLLAPSIBLE BARRICADE

[76] Inventor: Joseph Bechtold, 1046 Lighthouse Dr., Schaumburg, Ill. 60193

[21] Appl. No.: 425,481

[22] Filed: Oct. 23, 1989

[51] Int. Cl.[5] ..... E01F 15/00

[52] U.S. Cl. ..... 404/6; 220/8; 220/5 R; 220/DIG. 14; 206/1.5; 49/9

[58] Field of Search ..... 220/8, 9.1, 9.3, 9.2, 220/DIG. 12, DIG. 13, DIG. 14; 49/9, 125, 127, 133, 145; 285/396, 361; 206/1.5, 499, 503, 506, 509, 519; 404/6

[56] References Cited

U.S. PATENT DOCUMENTS 974,897 11/1910 Ljunggren ..... 285/396
2,211,326 8/1940 Gillice ..... 220/8
2,990,970 7/1961 Murdock ..... 220/8
4,624,382 11/1986 Tontarelli ..... 220/8

*Primary Examiner*—Ramon S. Britts
*Assistant Examiner*—Roger J. Schoeppel
*Attorney, Agent, or Firm*—Douglas B. White

[57] ABSTRACT

There is provided a collapsible barrel-shaped barricade which telescopes within itself for compact storage. Particularly, a solid and heavy base is provided for stability and a series of telescoping ring members are mounted thereon; the lowest ring being mounted to the base and upper rings being concentric with the lower ring. The concentric rings are arranged to interlock by placement of a tab from an inner ring into a horizontal slot on the inside of an outer ring. This interlock operates to hold the rings in an extended position when the barricade is in use.

7 Claims, 3 Drawing Sheets

FIG. 2
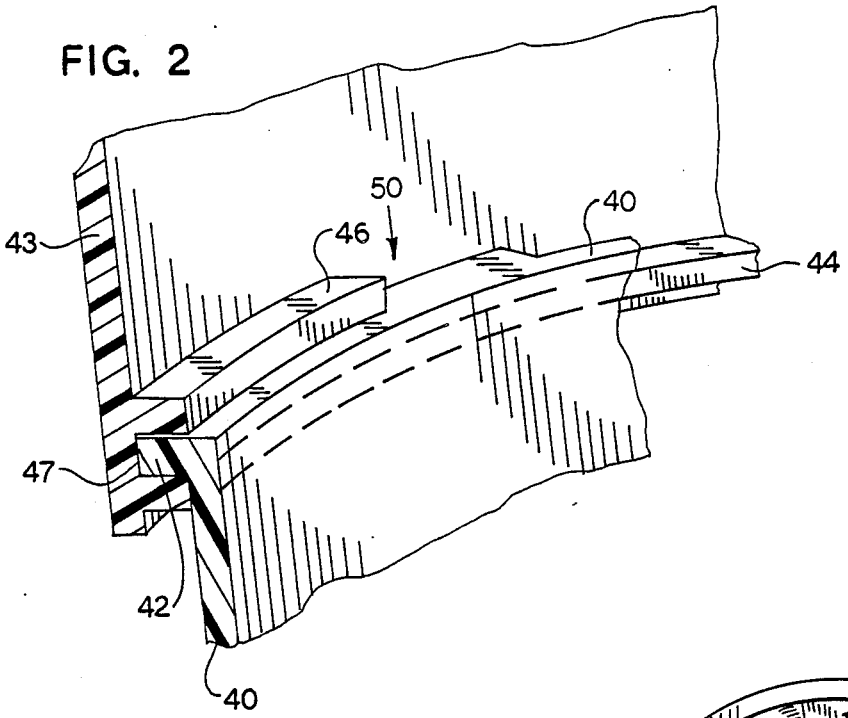
FIG. 3
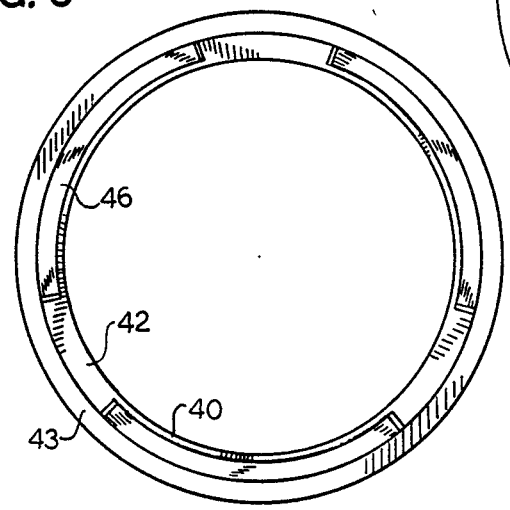
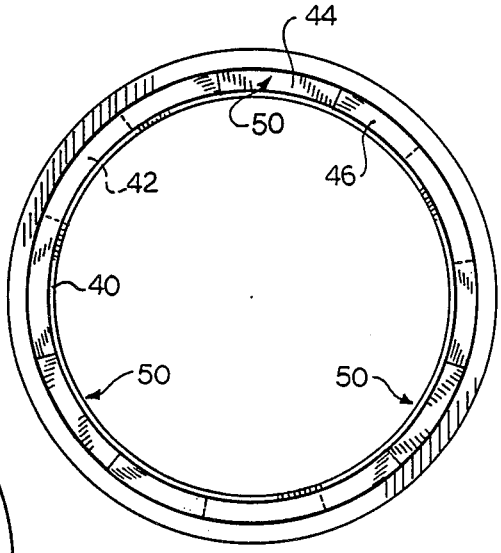
FIG. 4

COLLAPSIBLE BARRICADE

BACKGROUND OF THE INVENTION

1. Field of the Invention

This invention relates generally to barricades and more particularly to those devices used as a warning display for road hazards.

2. Description of the Prior Art

In the prior art barrel-shaped barricades and warning displays are of a large, bulky and generally heavy design. But most importantly, given the usual size and quantity of barrel barricades employed in roadwork and traffic control, storage of the units not in service becomes an expensive space consuming problem.

SUMMARY OF THE INVENTION

In order to eliminate such storage problems, there is provided herein a collapsible barrel-shaped barricade which telescopes within itself for compact storage. Particularly, a supporting base is provided for stability and a series of telescoping ring members are concentrically mounted thereon; the lowest ring being mounted to the base and upper rings being concentric with the lower ring. Adjacent rings overlap and are arranged to interlock by placement of tabs from an inner ring into slots on the inside of an outer ring. This interlock operates to hold the rings in an extended position when the barricade is in use. A lid member and center rod and warning lights may optionally be affixed to the completed structure.

BRIEF DESCRIPTION OF THE DRAWINGS

FIG. 2 is a perspective view of a portion of the rings showing the ring interlocking feature.

FIG. 3 is a plan view of the locking feature in an unlocked position.

FIG. 4 is a plan view of the ring locking feature in a locked position.

While the invention will be described in connection with a preferred embodiment, it will be understood that I do not intend to limit the invention to that embodiment. Particularly, while the telescoping feature is being described with progressively larger rings on top, it is within the scope of the invention to reverse the order and so modify the structure. It is therefore clear that I intend to cover all alternatives, modifications, and equivalents as may be included within the spirit and scope of the invention as defined by the appended claims and the doctrine of equivalents.

DESCRIPTION OF THE PREFERRED EMBODIMENT

Figure 1:
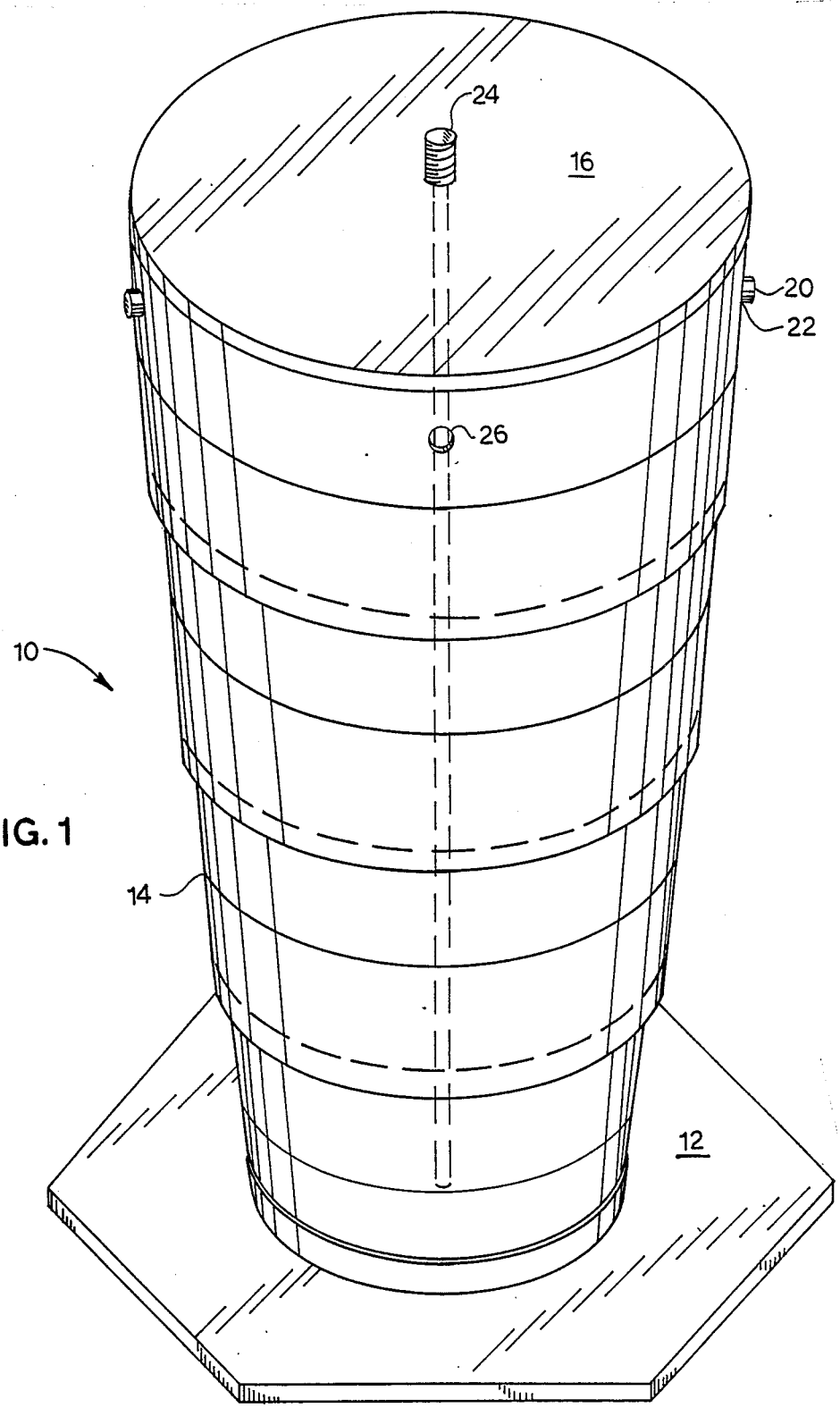
FIG. 1 is a perspective view of the barrel apparatus of the invention showing the concentric telescoping rings extended and locked one to another.
Figure 5:
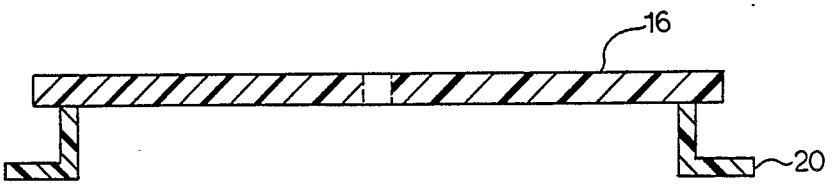
FIG. 5 is a cross-sectional view of the lid member showing the attaching prongs.

Turning to FIG. 1, there is shown the collapsible barrel style barricade in accordance with the present invention. This barrel, indicated generally by numeral 10, mounts to a base 12 and projects upwardly therefrom. This base is of an angular shape (such as hexagonal) and typically of a heavy and solid construction to support the structure. The body of the barrel consists of tapered rings 14 of progressively larger size arranged to interlock with adjacent rings at the point of overlap.

Closing the top of the barrel, a lid member 16 is arranged to mount and attach to the uppermost ring. In the embodiment shown, the lid projects flexible prong members 20 downwardly therefrom to latch into holes 22 in the upper ring. Additionally, a post member 24 is arranged to mount to the base and project through the lid to provide an accessible threaded portion. This is used to give the apparatus increased support and to provide accessible means to lift and position the barrel. Additional holes 26 in the top ring member are available for mounting of signage or warning signals when the barricade is put in service. Once positioned in the desired service location, the apparatus may be filled with ballast material such as sand or water.

The latching mechanism of the present invention is shown in FIGS. 2–4. Particularly, turning first to FIG. 2, each lower ring 40 has spaced tab members 42 protruding from its upper edge, and each upper ring 43 has located near its lower edge, a plurality of slots 47 formed by upper and lower edges 44 and 46 to receive the aforesaid tab. (In an equivalent version, the slot may be imbedded within the side wall.) These slots, and particularly the upper edge thereof, preferably slope downwardly in the direction of the locking rotation of extend the apparatus maximally and force the sections tightly together when locked. Each ring member, with the exception of the uppermost and lowermost rings, will serve as both an upper and lower ring in the locking function and will exhibit tabs at their upper edge and slots at their lower edge. The lowermost ring presents a tab to lock into the ring adjacent to and overlapping it, and the top ring has slots for engagement with the tabs of the next lower ring.

To obtain the collapsed condition, each upper ring is arranged to position gaps 50 located between the spaced slots at the tab locations of the lower adjacent ring, as shown in FIG. 3. The tabs are allowed to slide vertically from between the slots as each upper ring is allowed to fit over and surround the ring (or rings) below it. When all rings are so positioned, they telescope (collapse) together and rest on the base.

To obtain the extended uncollapsed condition, each ring is separately moved to its furthest extension relative to the adjacent ring below it and the gap between slots of the upper ring is positioned as shown in FIG. 3. Rotation of the upper ring relative to the lower adjacent ring then moves the tab within the slot to the position shown in FIG. 2 and 4. With the upper edge of the slot sloping downwardly, as the rings are rotated the tab contacts the upper edge of the slot to urge the upper ring to further extension. The lower edge 44 of the upper ring is consequently pulled progressively tighter against the periphery of the lower ring. This rotational engagement procedure is repeated for each ring as they are raised from their telescoped position. Once all rings are raised and latched, the lid and center post may be attached if desired.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A barricade apparatus comprising:

a base member having a first ring member affixed thereto;

a plurality of upper ring members concentric with said first ring member whereon adjacent ring members overlap, thereby defining an inner and outer ring member; and means for interlocking adjacent ring members comprising, a plurality of tabs extending from the outer periphery of said inner ring members proximate the overlapped edges thereof, and a plurality of spaced horizontally oriented slots defined on the inner periphery of said outer ring members proximate the overlapping edges thereof, said slots being arranged to exhibit openings between said slots to allow vertical entry of said tab members therein, and wherein said slots are arranged to receive said tab members upon relative horizontal rotation of said adjacent ring members;

whereby adjacent ring members are interlocked by first positioning said ring members such that said tab members are located within said openings between said slots and aligned with said slots, and then rotating said ring members to move said tab members into said slots.

2. The barricade apparatus of claim 1 wherein the lower edge of said slots are joined to form a continuous lower edge circumscribing said ring members.

3. The barricade apparatus of claim 1 wherein the upper edge of each of said slots slope downwardly in the direction of locking rotation.

4. The barricade apparatus of claim 1 wherein said slots are imbedded within the walls of said ring members.

5. The barricade apparatus of claim 1 further comprising a lid member having prongs depending therefrom arranged to mate with the uppermost of said ring members to secure the lid thereto.

6. The barricade apparatus of claim 5 further comprising a center rod removably affixed to the base and arranged to protrude through said lid member.

7. The barricade apparatus of claim 5 further comprising means located on the uppermost ring member for mounting of signage.

* * * * *